US011938978B2

(12) United States Patent
Schmidt et al.

(10) Patent No.: US 11,938,978 B2
(45) Date of Patent: Mar. 26, 2024

(54) DETERMINATION OF TRAIN DIRECTION FOR BI-DIRECTIONAL GRADE CROSSINGS

(71) Applicant: Siemens Mobility, Inc., New York, NY (US)

(72) Inventors: Holger Schmidt, Saint Johns, FL (US); Richard Bamfield, Ruby Bay (NZ)

(73) Assignee: Siemens Mobility, Inc., New York, NY (US)

( * ) Notice: Subject to any disclaimer, the term of this patent is extended or adjusted under 35 U.S.C. 154(b) by 553 days.

(21) Appl. No.: 17/217,214

(22) Filed: Mar. 30, 2021

(65) Prior Publication Data

US 2022/0315071 A1 Oct. 6, 2022

(51) Int. Cl.
*B61L 1/18* (2006.01)

(52) U.S. Cl.
CPC ..... *B61L 1/181* (2013.01)

(58) Field of Classification Search
CPC ..... B61L 1/181; B61L 29/00; B61L 29/02; B61L 29/08; B61L 29/18; B61L 29/22; B61L 29/222; B61L 29/224; B61L 29/226; B61L 29/28; B61L 29/284; B61L 29/286
See application file for complete search history.

(56) References Cited

U.S. PATENT DOCUMENTS

2016/0096540 A1* 4/2016 Cipollone ..... B61L 25/021 701/19

* cited by examiner

*Primary Examiner* — Robert J McCarry, Jr.

(57) ABSTRACT

A grade crossing control system includes a track circuit with a grade crossing predictor (GCP) system coupled to rails of a railroad track at a grade crossing, wherein a railroad vehicle travelling on the railroad track causes a change of impedance when entering the track circuit, and wherein the GCP system generates grade crossing activation signals in response to the change of the impedance of the track circuit, wherein, for detecting the change of impedance, the GCP system includes a first transmitter transmitting a first signal over the track circuit and a first receiver detecting a first response signal, a second transmitter transmitting a second signal over the track circuit and a second receiver detecting a second response signal, wherein the first transmitter and the first receiver are preprogrammed to a first frequency, and wherein the second transmitter and the second receiver are preprogrammed to a second frequency.

17 Claims, 2 Drawing Sheets

DETERMINATION OF TRAIN DIRECTION FOR BI-DIRECTIONAL GRADE CROSSINGS

BACKGROUND

1. Field

Aspects of the present disclosure generally relate to railroad crossing control systems including railroad signal control equipment such as for example a grade crossing predictor system.

2. Description of the Related Art

Railroad signal control equipment includes for example a constant warning time device, also referred to as a grade crossing predictor (GCP) in the U.S. or a level crossing predictor in the U.K., which is an electronic device that is connected to rails of a railroad track and is configured to detect the presence of an approaching train and determine its speed and distance from a crossing, i.e., a location at which the tracks cross a road, sidewalk or other surface used by moving objects. The constant warning time device will use this information to generate a constant warning time signal for a crossing warning device.

A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices are typically configured to activate the crossing warning device(s) at a fixed time, also referred to as warning time (WT), which can be for example 30 seconds, prior to the approaching train arriving at the crossing.

Typical constant warning time devices include a transmitter that transmits a signal over a circuit, herein referred to as track circuit, formed by the track's rails, for example electric current in the rails, and one or more termination shunts positioned at desired approach distances, also referred to as approach lengths, from the transmitter, a receiver that detects one or more resulting signal characteristics, and a logic circuit such as a microprocessor or hardwired logic that detects the presence of a train and determines its speed and distance from the crossing. The approach length depends on the maximum allowable speed (MAS) of a train, the desired WT, and a safety factor.

The Federal Railroad Administration (FRA) mandates warning time validation per route, which requires the system to determine the direction of a railway vehicle, herein also referred to as train. In crossings with constant warning time devices that use a so-called bi-directional setup with a traditional 4-wire system, the crossing warning system cannot discern a direction of the train, thus the warning time validation per route cannot be automated based on information from the crossing warning system alone.

SUMMARY

Briefly described, aspects of the present disclosure relate to railroad crossing control systems including railroad signal control equipment comprising for example a grade crossing predictor (GCP) system.

A first aspect of the present disclosure provides a grade crossing control system comprising a track circuit comprising a grade crossing predictor (GCP) system coupled to rails of a railroad track at a grade crossing, wherein a railroad vehicle travelling on the railroad track causes a change of impedance when entering the track circuit, and wherein the GCP system generates grade crossing activation signals in response to the change of the impedance of the track circuit, wherein, for detecting the change of impedance, the GCP system comprises a first transmitter transmitting a first signal over the track circuit and a first receiver detecting a first response signal, a second transmitter transmitting a second signal over the track circuit and a second receiver detecting a second response signal, wherein the first transmitter and the first receiver are preprogrammed to a first frequency, and wherein the second transmitter and the second receiver are preprogrammed to a second frequency.

A second aspect of the present disclosure provides a grade crossing predictor (GCP) system comprising a first transmitter configured to transmit a first signal over rails of a railroad track and a first receiver configured to detect a first response signal, a second transmitter configured to transmit a second signal over the rails of the railroad track and a second receiver configured to detect a second response signal, wherein the first transmitter and first receiver are preprogrammed to a first frequency, and wherein the second transmitter and second receiver are preprogrammed to a second frequency.

DETAILED DESCRIPTION

To facilitate an understanding of embodiments, principles, and features of the present disclosure, they are explained hereinafter with reference to implementation in illustrative embodiments. In particular, they are described in the context of being a railroad crossing control system including a grade crossing predictor (GCP) system. Embodiments of the present disclosure, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
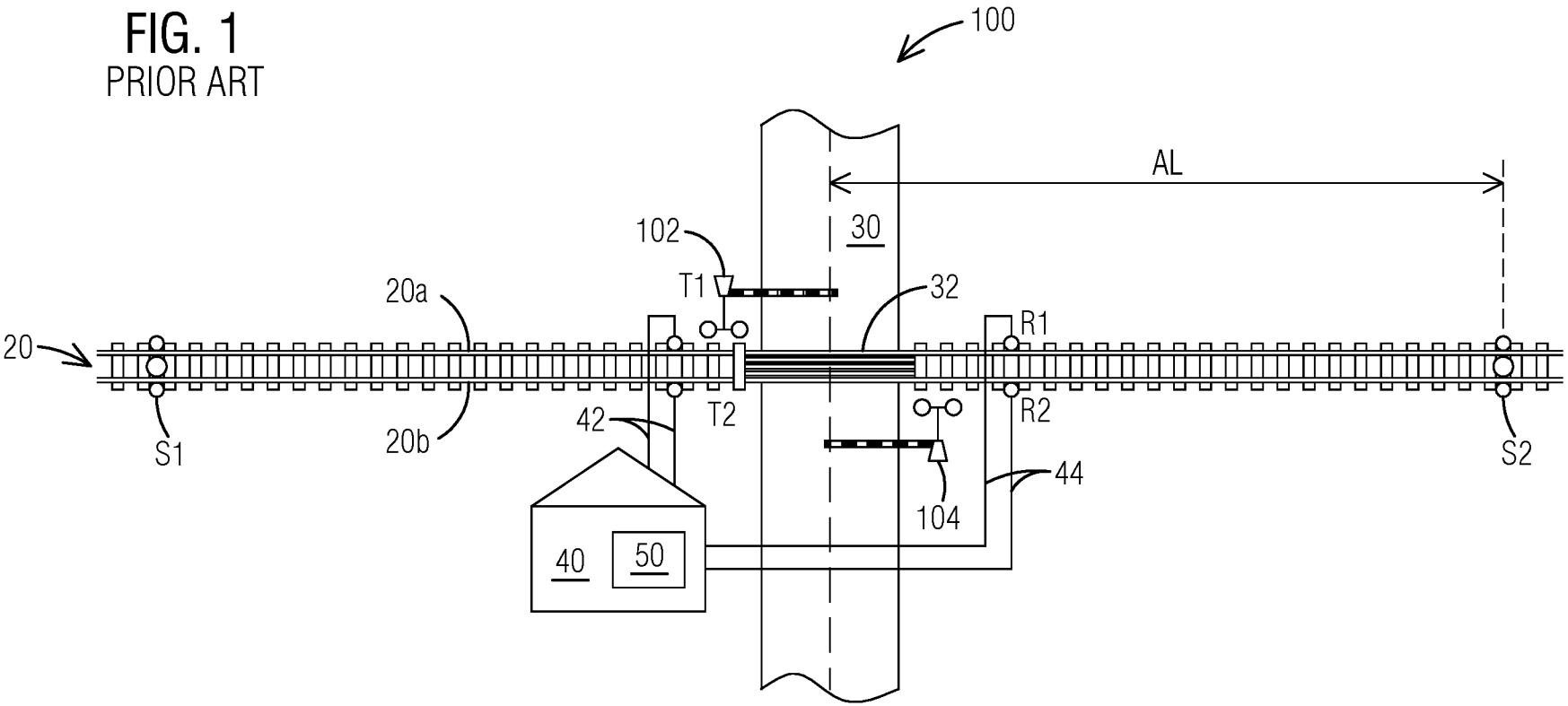
FIG. 1 PRIOR ART
FIG. 1 illustrates an example of a known railroad crossing control system in accordance with an embodiment disclosed herein.

FIG. 1 illustrates a known railroad crossing control system 100 in accordance with a disclosed embodiment. Road 30 crosses a railroad track 20. The crossing of the road 30 and the railroad track 20 forms an island 32. The railroad track 20 includes two rails 20*a*, 20*b* and a plurality of ties (not shown) that are provided over and within railroad ballast (not shown) to support the rails 20*a*, 20*b*.

Active protection systems for at-grade highway crossings, herein also referred to as highway crossings or simply crossings, in North and South America as well as in Australia are mainly based on so-called Predictor and Motion Sensor technology. An example for this technology is grade crossing predictor system 40, herein also referred to as GCP or GCP system 40, which comprises a transmitter that connects to the rails 20*a*, 20*b* at transmitter connection points T1, T2 on one side of the road 30 via transmitter wires 42. The GCP system 40 also comprises a receiver that connects to the rails 20*a*, 20*b* at receiver connection points R1, R2 on the other side of the road 30 via receiver wires 44.

The GCP system 40 includes a control unit 50 connected to the transmitters and receivers. The control unit 50 includes logic, which may be implemented in hardware, software, or a combination thereof, for calculating train speed and distance, and producing activation signals for warning devices 102, 104 of the railroad crossing control system 100. The control unit 50 can be for example integrated into a central processing unit (CPU) module of the GCP system 40 or can be separate unit within the GCP system 40 embodied as a processing unit such as for example a microprocessor.

Also shown in FIG. 1 is a pair of track circuit termination shunts S1, S2, herein also simply referred to as termination shunts S1, S2, one on each side of the island 32/road 30 at a desired distance from the center of the island 32. It should be appreciated that FIG. 1 is not drawn to scale and that both shunts S1, S2 are approximately the same distance away from the center of the island 32. The termination shunts S1, S2, are arranged at predetermined positions corresponding to an approach length AL required for a specific maximum authorized train speed and warning time (WT) for the GCP system 40. For example, if a total WT of 35 seconds (which includes 30 seconds of WT and 5 seconds of reaction time of the GCP system 40) at 60 mph maximum authorized speed (MAS) of a train is required, a calculated approach length AL is approximately 3900 feet (1200 m). Thus, the shunts S1, S2 are arranged each at 3900 feet from the center of the island 32. It should be noted that one of ordinary skill in the art is familiar with calculating the approach length AL. The termination shunts S1, S2 can be embodied for example as narrow band shunts (NBS).

Typically, the termination shunts S1, S2 positioned on both sides of the road 30 and the associated GCP system 40 are tuned to a same frequency. This way, the transmitter can continuously transmit one AC signal having one frequency, the receiver can measure the voltage response of the rails 20*a*, 20*b* and the control unit 50 can make impedance and constant warning time determinations based on the one specific frequency. When a train crosses one of the termination shunts S1, S2, the train's wheels and axle(s) act as shunts, which lower the impedance, as long as the train moves in the direction of the island 32, and voltage is measured by the corresponding control unit 50. Measuring the value of the impedance indicates the distance of the train and measuring the rate of change of the impedance allows the speed of the train to be determined.

It should be noted that the term GCP system as used herein refers to many types or components of railroad control equipment suitable for controlling railroad/grade crossings and/or generating railroad/grade crossing activation signals. For example, the GCP system 40 can be configured to include predictor and motion sensor technology or can be configured to only include motion sensor technology. Further, the GCP system 40 can be configured as a type of constant warning time device. The GCP system 40 as used herein presents only an example of a system for generating railroad/grade crossing activation signals.

The system 100 illustrates a bi-directional setup including a traditional 4-wire system. In crossings with GCP system 40 that use the bi-directional setup with four-wire system, the GCP system 40 cannot discern a direction of an approaching train. However, it may be necessary or required to determine a train's direction when approaching and travelling through the crossing. For example, railroad providers/authorities may be interested in a route a train is taking when traversing through a crossing. This interest originates from a regulatory requirement of validating the actual warning time the train moves over the crossing.

Figure 2:
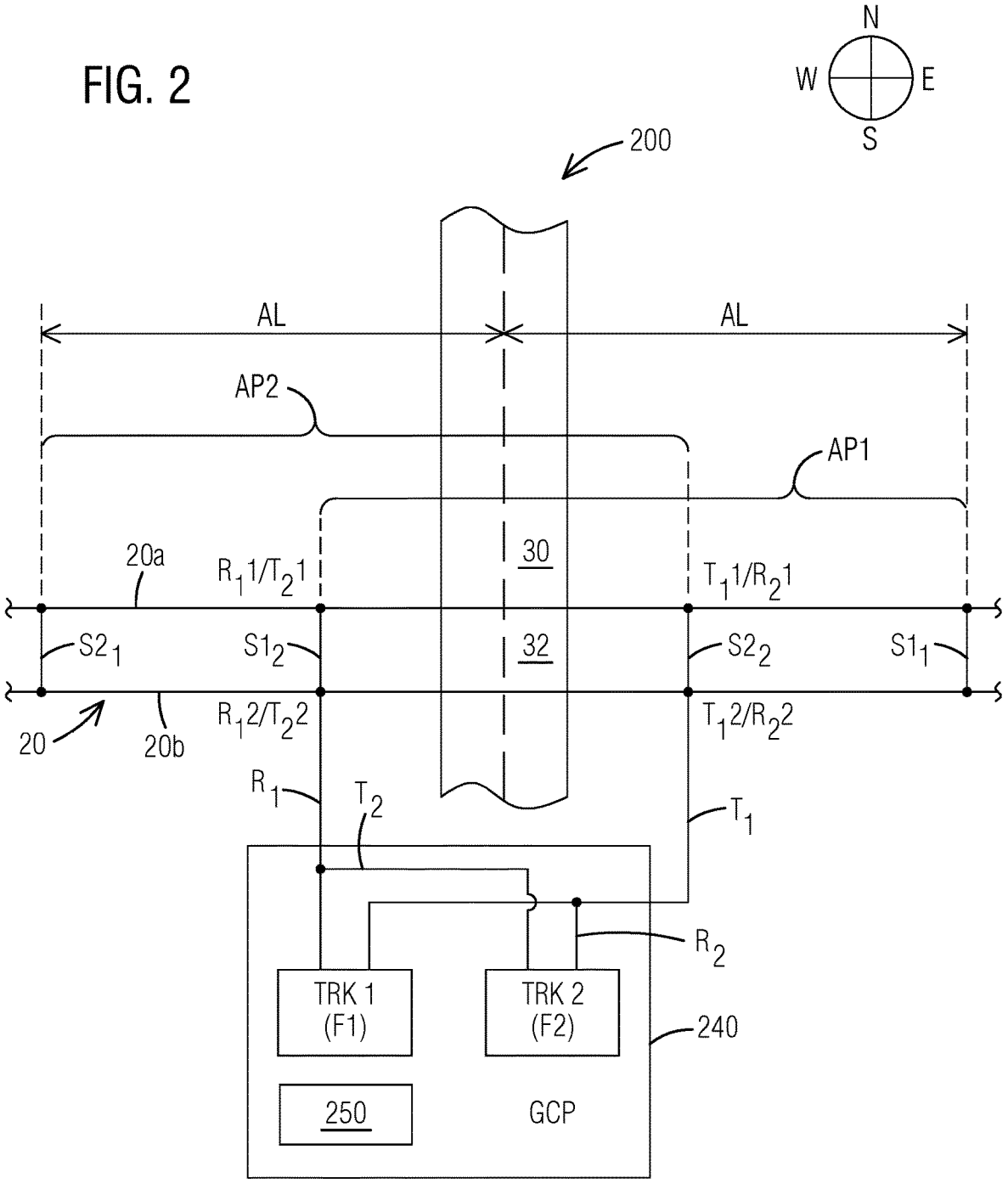
FIG. 2 illustrates a railroad crossing control system including a grade crossing predictor system in accordance with an exemplary embodiment of the present disclosure.

FIG. 2 illustrates a railroad crossing control system 200 including a grade crossing predictor system 240 in accordance with an exemplary embodiment of the present disclosure. Road 30 crosses railroad track 20. The crossing of the road 30 and the railroad track 20 forms an island 32. The railroad track 20 includes rails 20*a* and 20*b* and a plurality of ties (not shown) that are provided over and within railroad ballast (not shown) to support the rails 20*a*, 20*b*.

The railroad crossing control system 200 includes GCP system 240, including control unit 250, with a bi-directional four-wire system. Specifically, system 200 includes transmitters $T_1$, $T_2$ and receivers $R_1$, $R_2$ coupled to the rails 20*a*, 20*b* of railroad track 20 at connection points T and R.

FIG. 2 further illustrates track circuit termination shunts $S1_1$, $S1_2$, $S2_1$ and $S2_2$ arranged at each side of the island 32. Termination shunts $S1_1$ and $S2_1$ are located at a desired distance from the center of the island 32 corresponding to an approach length AL required for a specific maximum authorized train speed and warning time (WT) for the GCP system 240. Termination shunts $S1_2$ and $S2_2$ will be explained in the following description.

In an exemplary embodiment of the present disclosure, the railroad crossing control system 200, herein also referred to as grade crossing control system, is configured such that the bi-directional approach/setup is split or divided into two half approaches or half approach circuits AP 1 and AP 2, wherein the two approaches AP 1, AP 2 allow determination of speed and distance of a train approaching the island 32 as well as direction of the train.

Specifically, a first transmitter $T_1$ is coupled to the rails 20*a*, 20*b* via connection points $T_1$1 and $T_1$2, and first receiver $R_1$ is coupled to the rails 20*a*, 20*b* via connection points $R_1$1 and $R_1$2. The first transmitter $T_1$ transmits a first signal over the half approach circuit AP 1 and the first receiver $R_1$ detects a first response signal. The approach circuit AP 1 ends with termination shunts $S1_1$ and $S1_2$.

A second transmitter $T_2$ is coupled to the rails 20*a*, 20*b* via connection points $T_2$1 and $T_2$2, and second receiver $R_2$ is coupled to the rails 20*a*, 20*b* via connection points $R_2$1 and $R_2$2. The second transmitter $T_2$ transmits a second signal over the other half approach circuit AP 2 and the second receiver $R_2$ detects a second response signal. The approach circuit AP 2 ends with termination shunts $S2_1$ and $S2_2$.

The first transmitter $T_1$ and the first receiver $R_1$ are preprogrammed to a first frequency F1, and the second transmitter $T_2$ and the second receiver $R_2$ are preprogrammed to a second frequency F2. Specifically, the first frequency F1 is different than the second frequency F2.

As different frequencies F1 and F2 are used for the different approach circuits AP 1 and AP 2, each approach circuit AP 1 and AP 2 is terminated or defined by corresponding termination shunts at each end of the circuit AP 1 and AP 2. Thus, approach circuit AP 1 comprises termination shunts $S1_1$, $S1_2$, arranged on opposite sides of the island 32. Approach circuit AP 2 comprises termination shunts $S2_1$, $S2_2$, arranged on opposite sides of the island 32, as illustrated in FIG. 2. Termination shunts $S1_2$ and $S2_2$ can be implemented via electrical connections of the GCP system 240, for example utilizing transmitter and/or receiver cables.

The transmitter $T_1$ continuously transmits a first AC signal having the first frequency F1, and the transmitter $T_2$ transmits a second AC signal having the second, different frequency F2 over the rails 20*a*, 20*b*. The receivers $R_1$, $R_2$ measure voltage responses of the rails 20*a*, 20*b*, and the GCP system 240 can make impedance and constant warning time and train direction determinations based on the frequencies F1, F2.

By using different frequencies F1, F2, the GCP system 240 is able to not only detect the presence of a train, determine speed and distance from the island 32 of the train, but also determine the train's direction, because the train enters first either the approach circuit AP 1 comprising the first frequency F1 or the approach circuit AP 2 comprising the second frequency F2.

In our example, when a train approaches the crossing and enters first the approach circuit AP 1 (and afterwards AP 2), the GCP system 240 is able to determine that the train travels from East to West. In contrast, when a train enters the approach circuit AP 2 first (and then AP 1), the GCP system 240 is able to determine that the train travels from West to East.

In another exemplary embodiment, the first transmitter $T_1$ and the second receiver $R_2$ utilize a same first electrical connection to the rails 20*a*, 20*b*, and the second transmitter $T_2$ and the first receiver $R_1$ utilize a same second electrical connection to the rails 20*a*, 20*b*. This means that the first frequency F1 and the second frequency F2 are superimposed on the same first and second electrical connections. As FIG. 2 illustrates, $R_1$ and $T_2$ are coupled to the rails 20*a*, 20*b* via the same connection points $R_1$ 1/$T_2$1 and $R_1$2/$T_2$2. $R_2$ and $T_1$ are coupled to the rails 20*a*, 20*b* via the same cable and connection points $R_2$1/$T_1$ 1 and $R_2$2/$T_1$2. Further, shunt $S1_2$ is connected via the same cable and connection points $R_1$ 1/$T_2$1 and $R_2$2/$T_2$2, and shunt $S2_2$ is connected via the same cable and connection points $R_2$1/$T_1$1 and $R_2$2/$T_1$2.

The railroad crossing control system 200 includes an arrangement that effectively creates two islands and two approaches AP 1, AP 2, allowing determination of a train's direction without the need of extra field cables (F1 and F2 are superimposed on the same cable) or insulated joints.

In an exemplary embodiment, the GCP system 240 is configured such that it comprises additional GCP transmitter(s)/receiver(s), specifically one transmitter/receiver set per track, to be able to determine train direction. It should be noted that the described system 200 may comprise one or more, for example two or three, additional transmitter/receiver sets, depending on for example the number of tracks of a grade crossing.

The proposed railroad crossing control system 200, specifically the GCP system 240, can be used as an add-on solution for existing Predictor or Motion Sensor systems or GCP systems of highway crossing protection systems. In an example, it can require installation of an extra GCP track card per track. Certain installed GCP systems may have an extra slot available, while other GCP systems may require a different chassis with available track card slot(s). In either case, no additional field cable(s) or insulated joint(s) are required.

It should be noted that the GCP system 240 as described herein is only an example of a grade crossing control system. Many other types or components of railroad control equipment suitable for controlling railroad/grade crossings and/or generating railroad/grade crossing activation signals may be used. For example, the system 240 can be configured to include predictor and motion sensor technology or can be configured to only include motion sensor technology. Further, the system 240 can be configured as a type of constant warning time device. The GCP system 240 as used herein presents only an example of a system for generating railroad/grade crossing activation signals.

Other solutions for determining a train's direction when approaching and travelling through a crossing include a six-wire system, wherein the GCP system further comprises a check receiver that connects to the rails at check receiver connection points via check channel receiver wires. The check channel receiver wires are connected to the track on the same side of the road as the transmitter wires.

Other solutions include a design of back-to-back unidirectional setups, where an insulated joint separates the approach into two approaches that are each unidirectional; the use of external equipment such as sensors to determine the train direction; the use of cameras and motion sensors together with external equipment; and the use of office-based logic that combines information from Dispatch- or PTC systems with the warning time information from each crossing.

However, the six-wire setup and back-to-back unidirectional setup at an existing crossing require extra field cable(s) and, for the back-to-back setup the addition of an insulated joint. The use of sensors or cameras require extra equipment either within the railroad right-of-way or nearby and it adds complexity of correlating information of different equipment types. The use of office-based logic requires development of data interfaces and extensive correlation logic.

The invention claimed is:

1. A grade crossing control system comprising:

a track circuit comprising a grade crossing predictor (GCP) system coupled to rails of a railroad track at a grade crossing, wherein a railroad vehicle travelling on the railroad track causes a change of impedance when entering the track circuit, and wherein the GCP system generates grade crossing activation signals in response to the change of the impedance of the track circuit, wherein the GCP system comprises a first transmitter transmitting a first signal over the track circuit and a first receiver detecting a first response signal, a second transmitter transmitting a second signal over the track circuit and a second receiver detecting a second response signal, wherein the first transmitter and the first receiver are preprogrammed to a first frequency, and wherein the second transmitter and the second receiver are preprogrammed to a second frequency, and wherein the first transmitter and the second receiver utilize a same first electrical connection to the rails, and wherein the second transmitter and the first receiver utilize a same second electrical connection to the rails.

2. The grade crossing control system of claim 1, wherein the first frequency is different than the second frequency.

3. The grade crossing control system of claim 1, wherein the first frequency and the second frequency are superimposed on the same first and second electrical connections.

4. The grade crossing control system of claim 1, further comprising first termination shunts and second termination shunts.

5. The grade crossing control system of claim 4, wherein the first transmitter, the first receiver and the first termination shunts form a first approach circuit of the track circuit.

6. The grade crossing control system of claim 5, wherein the GCP system determines that the railroad vehicle travels in a first direction when the railroad vehicle enters the first approach circuit before entering the second approach circuit.

7. The grade crossing control system of claim 4, wherein the second transmitter, the second receiver and the second termination shunts form a second approach circuit of the track circuit.

8. The grade crossing control system of claim 7, wherein the GCP system determines that the railroad vehicle travels in a second direction when the railroad vehicle enters the second approach circuit before entering the first approach circuit.

9. The grade crossing control system of claim 1, wherein the GCP system determines speed, distance from a crossing island and direction of the railroad vehicle when entering the track circuit.

10. A grade crossing predictor (GCP) system comprising:

a first transmitter configured to transmit a first signal over rails of a railroad track and a first receiver configured to detect a first response signal, a second transmitter configured to transmit a second signal over the rails of the railroad track and a second receiver configured to detect a second response signal, wherein the first transmitter and first receiver are preprogrammed to a first frequency, wherein the second transmitter and second receiver are preprogrammed to a second frequency, and wherein the first transmitter and the second receiver are configured to utilize a same first electrical connection to the rails, and wherein the second transmitter and the first receiver are configured to utilize a same second electrical connection to the rails.

11. The GCP system of claim 10, wherein the first frequency is different than the second frequency.

12. The GCP system of claim 10, wherein the first frequency and the second frequency are superimposed on the same first and second electrical connections.

13. The GCP system of claim 10, further comprising a first track module for operating the first transmitter and first receiver at the first frequency, and a second track module for operating the second transmitter and second receiver at the second frequency.

14. The GCP system of claim 10, wherein the GCP system is configured to determine speed, distance from a grade crossing and direction of a railway vehicle.

15. The GCP system of claim 14, wherein the GCP system is configured to determine that the railroad vehicle travels in a first direction when a change of impedance is detected via the first response signal of the first receiver before a change of impedance is detected via the second response signal of the second receiver.

16. The GCP system of claim 14, wherein the GCP system is configured to determine that the railroad vehicle travels in a second direction when a change of impedance is detected via the second response signal of the second receiver before a change of impedance is detected via the first response signal of the first receiver.

17. The GCP system of claim 10, configured as bi-directional four-wire system without insulated joints.

* * * * *